US009132535B2

(12) United States Patent
Hsieh

(10) Patent No.: US 9,132,535 B2
(45) Date of Patent: Sep. 15, 2015

(54) ANGLE ADJUSTING STRUCTURE OF RATCHET WRENCH

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 243 days.

(21) Appl. No.: 14/037,384

(22) Filed: Sep. 26, 2013

(65) Prior Publication Data

US 2014/0090523 A1 Apr. 3, 2014

(30) Foreign Application Priority Data

Sep. 28, 2012 (TW) ..... 101218925

(51) Int. Cl.
*B25B 23/00* (2006.01)
*B25B 13/46* (2006.01)
*B25G 1/06* (2006.01)

(52) U.S. Cl.
CPC ..... *B25B 23/0028* (2013.01); *B25B 13/461* (2013.01); *B25G 1/063* (2013.01)

(58) Field of Classification Search
CPC ... B25B 23/0028; B25B 13/461; B25G 1/063
See application file for complete search history.

(56) References Cited

U.S. PATENT DOCUMENTS 4,901,608 A * 2/1990 Shieh ..... 81/177.8
6,000,302 A * 12/1999 Chiang ..... 81/177.8
6,186,034 B1 * 2/2001 Lamons ..... 81/177.9
6,295,898 B1 * 10/2001 Hsieh ..... 81/177.8
6,745,650 B1 * 6/2004 Chang ..... 81/177.8
6,886,429 B1 * 5/2005 Lee ..... 81/177.8
6,957,600 B2 * 10/2005 Hu ..... 81/177.8
7,000,507 B1 * 2/2006 Lin ..... 81/177.9
7,082,862 B2 * 8/2006 Lee ..... 81/177.8
7,171,875 B2 * 2/2007 Hu ..... 81/177.8
7,174,815 B1 * 2/2007 Hsieh ..... 81/177.9
7,197,966 B1 * 4/2007 Hsieh ..... 81/177.9
D545,154 S * 6/2007 Lin ..... D8/28
7,509,893 B2 * 3/2009 Wu ..... 81/177.8
8,028,607 B2 * 10/2011 Lee et al. ..... 81/60
2009/0090223 A1 * 4/2009 Wu ..... 81/124.6
2009/0133542 A1 * 5/2009 Wu ..... 81/177.8
2012/0167727 A1 * 7/2012 Chen ..... 81/177.8

* cited by examiner

*Primary Examiner* — David B Thomas
(74) *Attorney, Agent, or Firm* — CKC & Partners Co., Ltd.

(57) ABSTRACT

An angle adjusting structure of a ratchet wrench includes a shank, a driving head, a located member, a spring and a detent member. The shank includes a pivot socket and a limiting portion. The pivot socket has a first pivoting portion and a bottom surface, the limiting portion is adjoined to the pivot socket and includes a limiting hole. The driving head includes a second pivoting portion which is pivotally connected to the first pivoting portion and has a plurality of meshing teeth. The located member is slidably located on the bottom surface. The located member includes a plurality of engagement teeth and a sliding rail, the engagement teeth is for meshing the meshing teeth, the sliding rail is correspondingly located on an outside of the limiting hole. The spring is located in the limiting hole. The detent member is connected to the spring and the sliding rail.

8 Claims, 7 Drawing Sheets

ANGLE ADJUSTING STRUCTURE OF RATCHET WRENCH

RELATED APPLICATIONS

This application claims priority to Taiwan Application Serial Number 101218925, filed Sep. 28, 2012, which is herein incorporated by reference.

BACKGROUND

1. Technical Field

The present disclosure relates to a ratchet wrench. More particularly, the present disclosure relates to an angle adjusting structure of a ratchet wrench.

2. Description of Related Art

In recent years, the non power driven hand tools are gradually replaced by the power driven hand tools for saving time and effort. Despite that, the non power driven hand tools are still the indispensable tools for the great majority of people from the standpoint about convenience and lightness.

A wrench or spanner is a tool used to provide grip and mechanical advantage in applying torque to turn threaded fasteners, such as nuts and bolts. Ratchet wrench is one kind of the wrench for gripping the nuts and bolts, More particularly, the Ratchet wrench has a ratcheting mechanism which attaches to a socket, which in turn fits on the bolts and nuts.

Mostly, the ratchet wrench ratchet mechanism is usually integrated design with a metal handle, awhile the manufacturing cost can be reduced, it is difficult to force threaded fasteners in the limited position or angle.

SUMMARY

According to one embodiment of the present disclosure, an angle adjusting structure of a ratchet wrench includes a shank, a driving head, a located member, a spring, and a detent ember. The shank includes a pivot socket and a limiting portion, wherein the pivot socket has a first pivoting portion and a bottom surface, the limiting portion is adjoined to the pivot socket and includes at least one limiting hole. The driving head includes a second pivoting portion, the second pivoting portion is pivotally connected to the first pivoting portion and has a plurality of meshing teeth, wherein an effective mesh width of each of the meshing teeth is smaller than a width of the bottom surface. The located member is linearly and slidably located on the bottom surface, the located member includes a plurality of engagement teeth and a sliding rail, the engagement teeth is for meshing the meshing teeth, wherein an effective mesh width of each of the engagement teeth is smaller than the width of the bottom surface, the sliding rail is correspondingly located on an outside of the limiting hole. The spring is located in the limiting hole. The detent member is connected to the spring and the sliding rail. The sum of the effective mesh width of each of the meshing teeth and the effective mesh width of each of the engagement teeth is equal or less than the width of the bottom surface.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
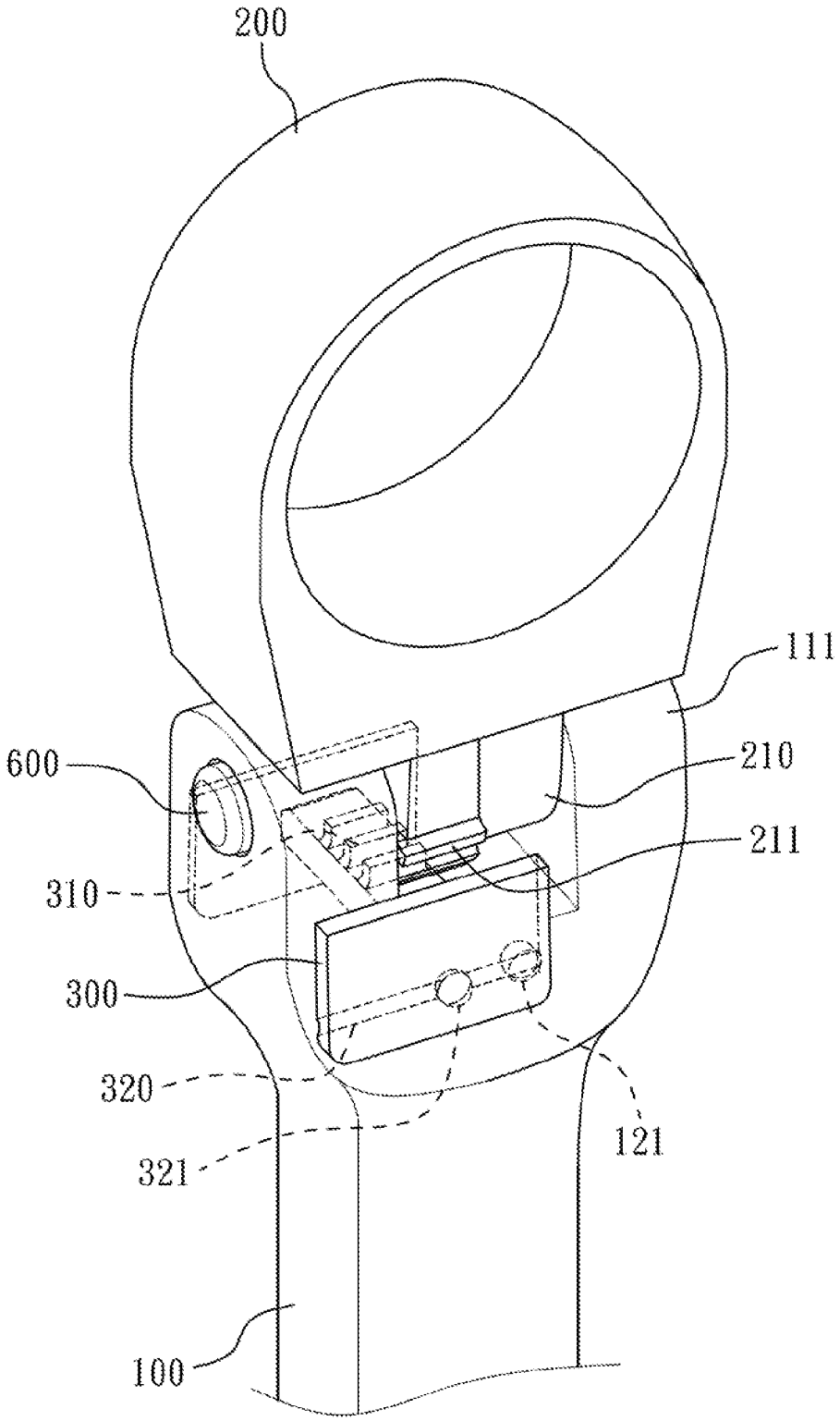
FIG. 1 is a schematic view of an angle adjusting structure of a ratchet wrench according to the first embodiment of the present disclosure.
Figure 2:
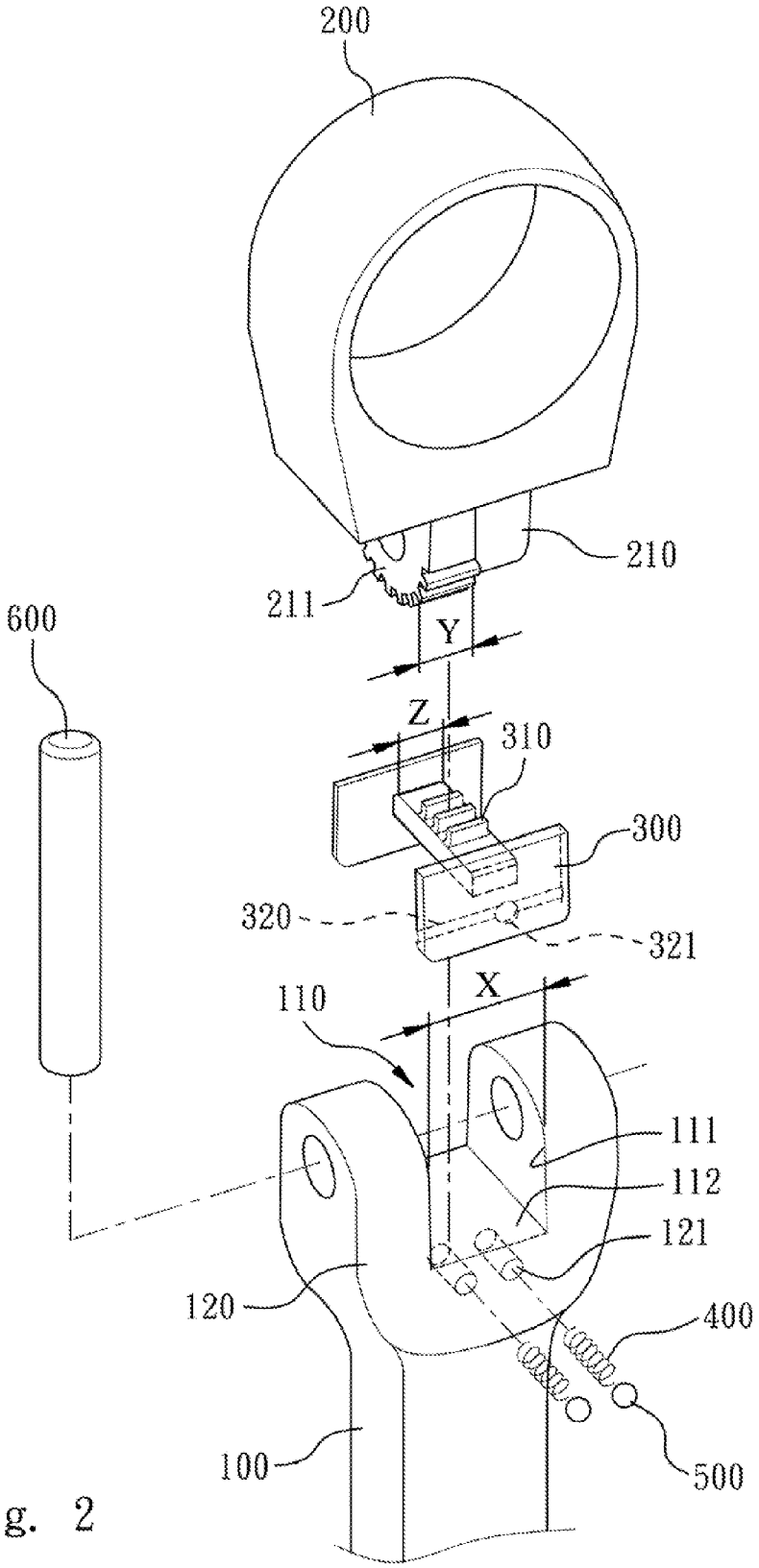
FIG. 2 is an exploded schematic view of the angle adjusting structure of the ratchet wrench of FIG. 1.

FIG. 1 is a schematic view of an angle adjusting structure of a ratchet wrench according to the first embodiment of the present disclosure FIG. 2 is an exploded schematic view of the angle adjusting structure of the ratchet wrench of FIG. 1. In FIG. 1 and FIG. 2, the angle adjusting structure of the ratchet wrench includes a shank 100, a driving head 200, a located member 300, two springs 400, two detent members 500, and a pivoting member 600.

The shank 100 includes a pivot socket 110 and a limiting portion 120. The pivot socket 110 has first pivoting portions 111 on both sides thereon and a bottom surface 112 with a length of X. The limiting portion 120 is adjoined to the pivot socket 110 and includes two limiting holes 121.

The driving head 200 includes a second pivoting portion 210, wherein the second pivoting portion 210 is pivotally connected to the first pivoting portion 111 and has a plurality of meshing teeth 211 arranged on the outside of the second pivoting portion 210 in an annular arrangement.

The located member 300 is linearly and slidably located on the bottom surface 112 of the pivot socket 110 of the shank 100. The located member 300 includes a plurality of engagement teeth 310 and a sliding rail 320 with a recess. The sliding rail 320 is parallel to the bottom surface 112 of the pivot socket 110 and correspondingly located on the outside of the limiting holes 121 of the limiting portion 120, and the sliding rail 320 has a locating groove 321. The engagement teeth 310 is for meshing the meshing teeth 211 of the second pivoting portion 210. The sum of an effective mesh width. Y of each of the meshing teeth 211 and an effective mesh Z width of each of the engagement teeth 310 is equal or less than the width X of the bottom surface 112, wherein the effective mesh width V of each of the meshing teeth 211 and the effective mesh width Z of each of the engagement teeth 310 are respectively smaller than the half length X of the bottom surface 112.

The spring 400 is located in the limiting hole 121. The decent member 500 is connected to the spring 400 and the sliding rail 320 of the located member 300, the detent member 500 can be replaced with different types, such as balls and pins. Thereby, the spring 400 pushes the detent member 500 that the detent member 500 is limited in the sliding rail 320 of the located member 300.

The pivoting member 600 axially connects the second pivoting portion 210 and the first pivoting portions 111. Thus, the driving head 200 is pivotally connected to the shank 100.

Figure 3:
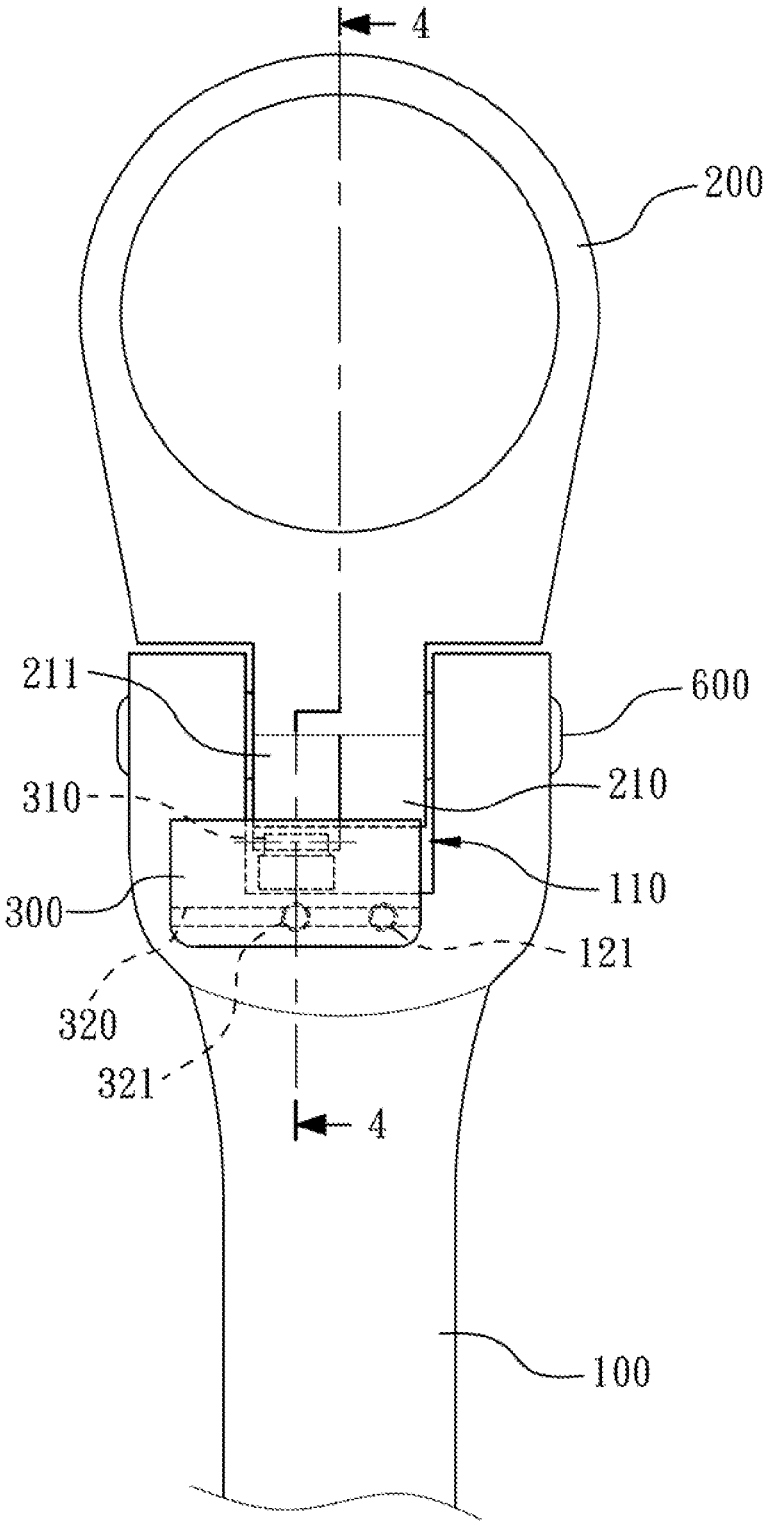
FIG. 3 is a schematic showing that the engagement teeth mesh the meshing teeth of FIG. 1.
Figure 4:
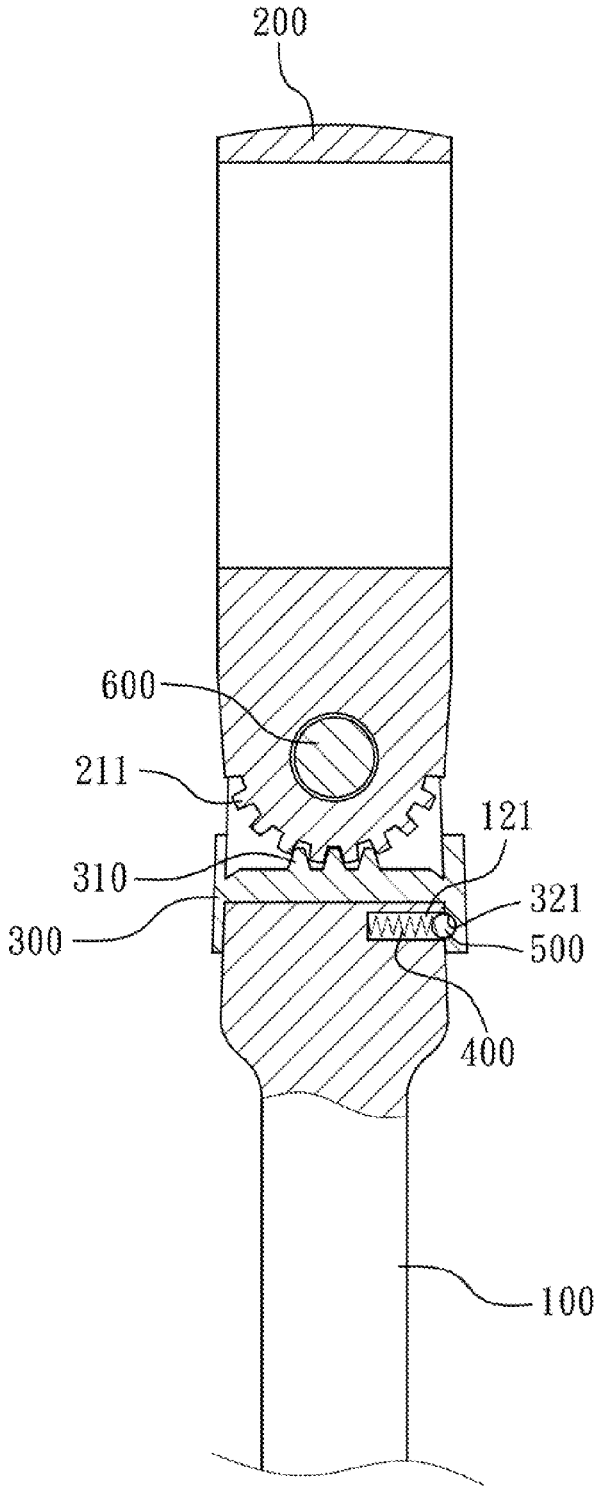
FIG. 4 is a cross-section view taken along the section line 4-4 of FIG. 3.

FIG. 3 is a schematic view showing that the engagement teeth 310 mesh the meshing teeth 211 of FIG. 1. FIG. 4 is a cross-section view taken along line 4-4 of FIG. 3. In FIG. 3 and FIG. 4, the engagement teeth 310 of the located member 300 mesh the meshing teeth 211 of the second pivoting portion 210 for fixing the rotation angle between the driving head 200 and the shank 100. However, the located member 300 is longer than to the pivot socket 110, so that the located member 300 can be adjusted by the elastic force from the spring 400 in the limiting hole 121. Hence, the engagement teeth 310 of the located member 300 and the meshing teeth 211 of the second pivoting portion 210 can be fully engaged. The located member 300 is fixed that utilizes the locating groove 321 of the sliding rail 320 to limit the detent member 500 while the spring 400 is pushing the detent member 500. Therefore, to handle the ratchet wrench according to the present disclosure with single hand is more stable and smooth.

Figure 5:
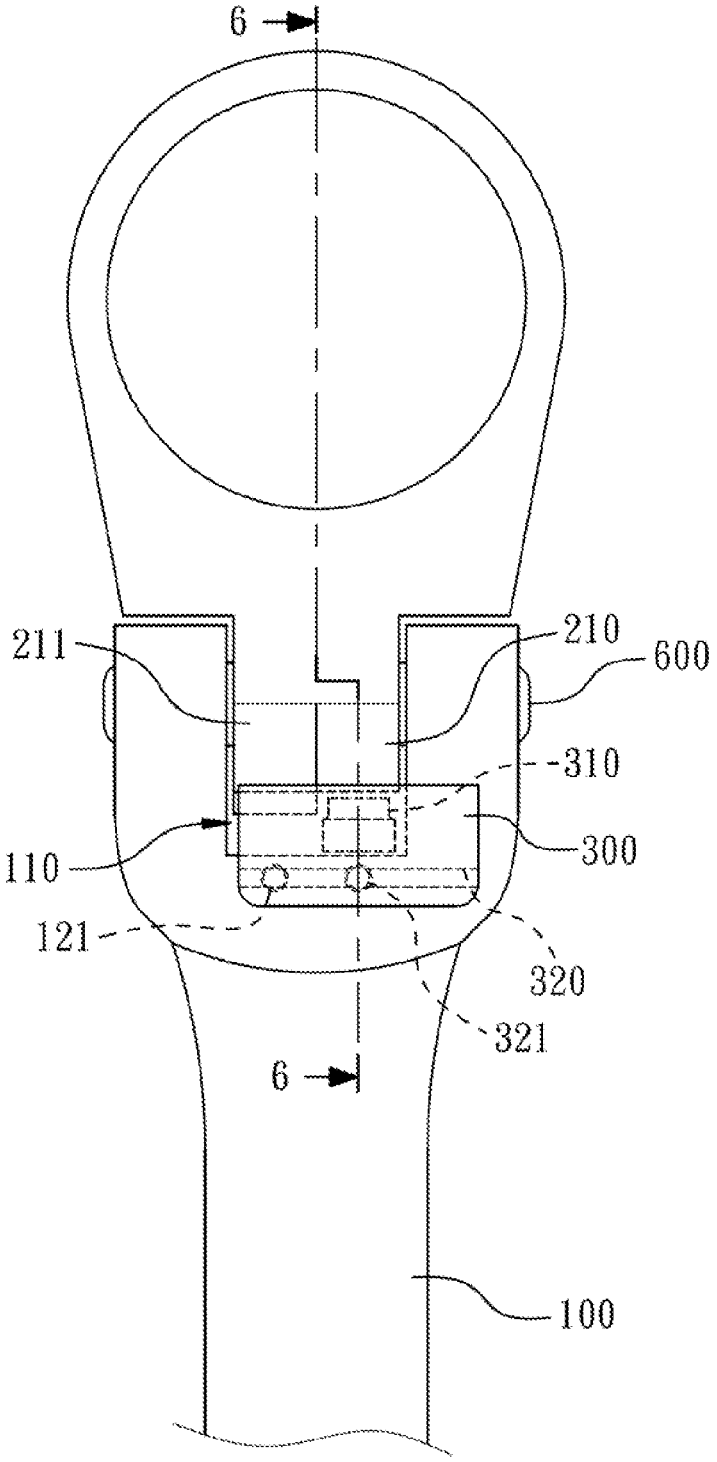
FIG. 5 is a schematic view showing that the engagement teeth are not meshed the meshing teeth of FIG. 1.
Figure 6:
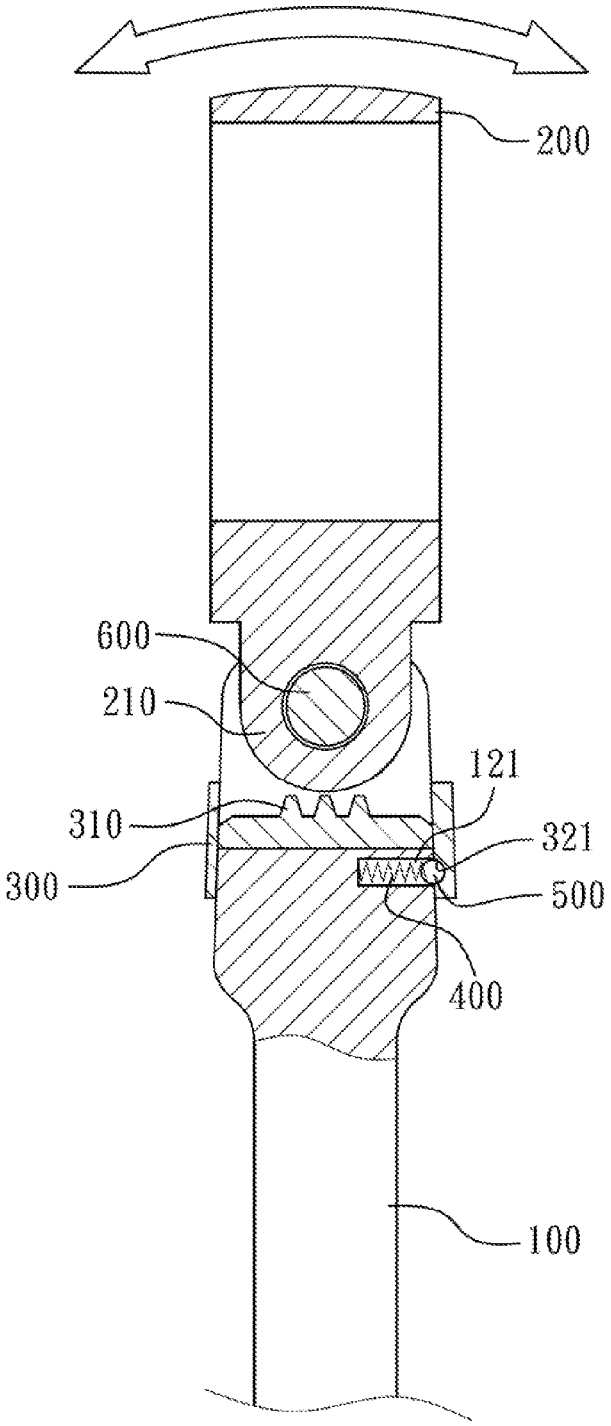
FIG. 6 is a cross-section view taken along the line 6-6 of FIG. 5.
Figure 7:
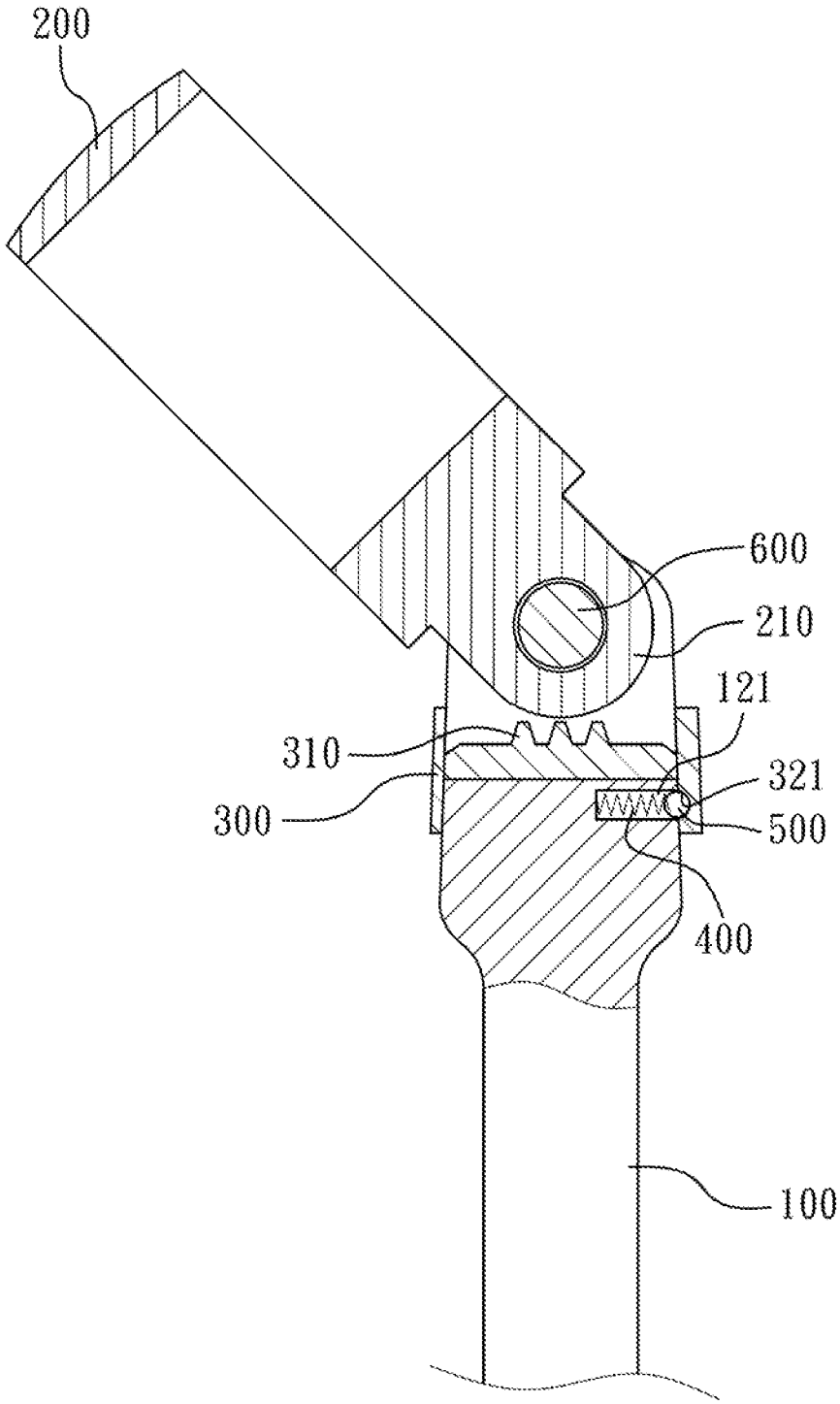
FIG. 7 is a schematic view of the angle adjusting structure of the ratchet. wrench of FIG. 6.

FIG. 5 is a schematic view showing that the engagement teeth 310 are not meshed the meshing teeth 211 of FIG. 1. FIG. 6 is a cross-section view taken along the line 6-6 of FIG. 5. FIG. 7 is a schematic view of the angle adjusting structure of the ratchet wrench of FIG. 6. In FIG. 5, FIG. 6, and FIG. 7, the engagement teeth 310 of the located member 300 are not meshed the meshing teeth 211 of the second pivoting portion 210, the rotation angle of the located member 300 can be adjusted by pivotally connecting the first pivoting portions 111 and the second pivoting portion 210 with the pivoting member 600. Meanwhile, the user can adjust the rotation angle of the driving head 200 in accordance with the threaded fasteners. Again, the located member 300 is fixed to avoid generating loose that utilizes the locating groove 321 of the sliding rail 320 to limit the detent member 500 while the spring 400 is pushing the detent member 500.

When the user adjusts the rotation angle between the driving head 200 and the shank 100, and repeats the operation showing as FIG. 3 and FIG. 4, the engagement teeth 310 of the located member 300 mesh the meshing teeth 211 of the second pivoting portion 210 to fix the rotation angle between the driving head 200 and the shank 100.

Particularly, the sliding rail 320 of the located member 300 further includes three locating grooves 321. In that case, the located member 300 moves left, and the engagement teeth 310 of the located member 300 mesh the meshing teeth 211 of the second pivoting portion 210, it makes the two detent members 500 just are located in the two locating grooves 321 which are on the left side, to fix the located member 300. On the other hand, the located member 300 moves right, and the two detent members 500 just are located in the two locating grooves 321 which are on the right side, it also can fix the located member 300.

It will be apparent to those skilled in the art that various modifications and variations can be made without departing from the scope or spirit of the present invention. Therefore, the scope of the present invention shall be defined by the appended claims.

What is claimed is:

1. An angle adjusting structure of a ratchet wrench, comprising:

a shank, comprising:

a pivot, socket having a first pivoting portion and a bottom surface; and a limiting portion adjoined to the pivot socket and comprising at least one limiting hole;

a driving head, comprising:

a second pivoting portion pivotally connected to the first pivoting portion and having a plurality of meshing teeth, wherein an effective mesh width of each of the meshing teeth is smaller than a width of the bottom surface;

a located member linearly and slidably located on the bottom surface, the located member comprising:

a plurality of engagement teeth for meshing the meshing teeth, wherein an effective mesh width of each of the engagement teeth is smaller than the width of the bottom surface; and a sliding rail correspondingly located an outside of the limiting hole;

a spring located in the limiting hole; and a detent member connected to the spring and the sliding rail;

wherein the sum of the effective mesh width of each of the meshing teeth and the effective mesh width of each of the engagement teeth is equal or less than the width of the bottom surface.

2. The angle adjusting structure of a ratchet wrench according to claim 1, wherein the effective mesh width of each of the meshing teeth and the effective mesh width of each of the engagement teeth are respectively smaller than the half length of the bottom surface.

3. The angle adjusting structure of a ratchet wrench according to claim 1, wherein the sliding rail has a locating groove for locating the detent member.

4. The angle adjusting structure of a ratchet wrench according to claim wherein the numbers of the limiting hole, the spring and the detent member are two respectively.

5. The angle adjusting structure of a ratchet wrench according to claim 4, wherein the sliding rail has three locating grooves arranged horizontally.

6. The angle adjusting structure of a ratchet wrench according to claim 1, wherein the meshing teeth are arranged in an annular arrangement.

7. The angle adjusting structure of a ratchet wrench according to claim wherein the located member is U-shaped.

8. The angle adjusting structure of a ratchet wrench according to claim further comprising:

a pivoting member axially connected to the second pivoting portion of the driving head and the first pivoting portion of the shank.

* * * * *